US006910959B2

(12) United States Patent
Eklund

(10) Patent No.: US 6,910,959 B2
(45) Date of Patent: Jun. 28, 2005

(54) FIXTURE FOR A GRINDING OR POLISHING WHEEL

(76) Inventor: Tore Eklund, Larstorpsvägen 13, Motala S-591 70 (SE)

( * ) Notice: Subject to any disclaimer, the term of this patent is extended or adjusted under 35 U.S.C. 154(b) by 0 days.

(21) Appl. No.: 10/480,485

(22) PCT Filed: May 15, 2002

(86) PCT No.: PCT/SE02/00919

§ 371 (c)(1),
(2), (4) Date: Apr. 16, 2004

(87) PCT Pub. No.: WO02/100596

PCT Pub. Date: Dec. 19, 2002

(65) Prior Publication Data

US 2004/0171337 A1 Sep. 2, 2004

(30) Foreign Application Priority Data

Jun. 13, 2001 (SE) ..... 0102125

(51) Int. Cl.[7] ..... B24B 41/06

(52) U.S. Cl. ..... 451/420; 451/419; 451/555; 451/438; 451/457

(58) Field of Search ..... 451/420, 419; 457/438, 193, 224, 192, 229, 248, 555, 457, 177, 185; 30/139; 69/38

(56) References Cited

U.S. PATENT DOCUMENTS 2,645,063 A * 7/1953 Smith ..... 451/231
2,652,667 A * 9/1953 Arnold ..... 451/555
3,229,426 A * 1/1966 Charles ..... 451/555
4,773,186 A * 9/1988 Kojima ..... 451/278
5,189,848 A 3/1993 Flaherty
5,191,737 A 3/1993 Snoddy
5,620,359 A 4/1997 Harrison et al.
6,083,088 A 7/2000 Hepworth
6,623,340 B2 * 9/2003 Jansson ..... 451/241

FOREIGN PATENT DOCUMENTS

AT 164849 11/1905
DE 3422882 1/1986

* cited by examiner

*Primary Examiner*—George Nguyen
(74) *Attorney, Agent, or Firm*—Young & Thompson

(57) ABSTRACT

A fixture (1) for guidance of a tool having a cutting edge with respect to the periphery of a rotating grinding or polishing wheel (2), comprising a frame structure that runs along the periphery (6) of the wheel and has a guide formed as a slot (17) with an open other end, the slot providing a support surface (19) that is sloping relative to the radius of the wheel, and the inner end of the slot terminating radially within the periphery of the wheel on each side thereof, the fixture (1) in one end supported (11) for pivoting motion in a main plane of the wheel and in the other end carrying a separate balance weight (12).

15 Claims, 1 Drawing Sheet

FIXTURE FOR A GRINDING OR POLISHING WHEEL

TECHNICAL FIELD

Figure 1:
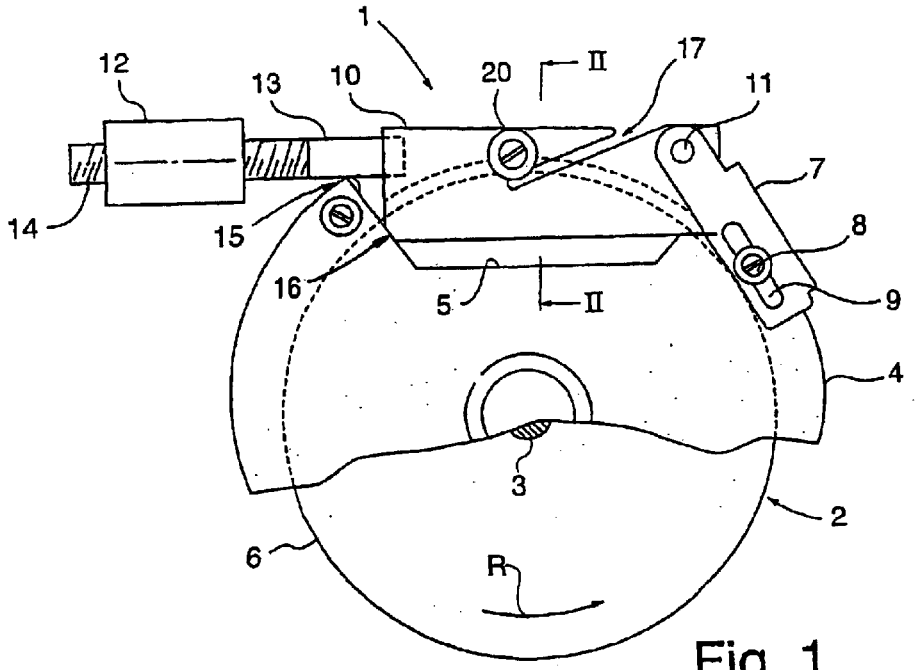

The invention relates to a fixture for grinding/polishing of cutting edges, in particular knife edges, by assistance from a rotating polishing- or grinding wheel. More specifically, the invention refers to a fixture for this purpose, being formed both to ensure a suitable working pressure towards the wheel upon shaping the edge, and to secure an optimal angle of operation. The fixture of the invention further prevents the treated subject to be positioned with the edge thereof placed towards the rotational direction of the wheel, as well as the unintentional contact with the rotating polishing or grinding wheel.

BACKGROUND AND PRIOR ART

When sharpening edges, and when degrading or polishing raw edges, rotating grinding- or polishing wheels are often used. The edge is then manually positioned at a slanting angle to be treated by the rotating periphery of the wheel. When treating knife edges, e.g., the wheel rotates transversely to the knife blade from the back of the knife towards the edge. When grinding/polishing the opposite side of the edge, the knife is swung round over it's ends. If the operator is untrained, there is a risk that the knife is instead turned about it's longitudinal axis so the edge is directed towards the rotational direction of the wheel, in which case the knife may cut into the wheel and damage the grinding- or polishing wheel. There is also a risk that the operator's grip on the knife is lost, and the knife being flung away by the rotating wheel.

Another problem associated with a free manual handling of the knife is that the grinding angle is difficult to control, and may also vary as the knife is longitudinally moved across the periphery of the wheel thus providing an unsatisfactory result.

Yet another problem is the risk of insufficient or excessive contact pressure applied to the wheel, in both cases resulting in unsatisfactory grinding- or polishing operations.

The invention aims to provide an apparatus that eliminates above said risks and drawbacks associated with the manually controlled grinding/polishing operation. This object is met in a fixture in accordance with appended claim 1. Advantageous embodiments are defined in the subordinated claims.

SUMMARY OF THE INVENTION

Briefly, the invention foresees a fixture having a guide for a knife blade, e.g., the guide being pivotally arranged on a grinding apparatus and based towards an operational position by means of a balance weight connected to the fixture. The guide is formed to ensure an optimum operation angle between the knife and the periphery of a wheel, and to prevent the knife blade from being wedged in the guide as a result of frictional engagement between knife and wheel. Furthermore, the contact pressure of the knife edge towards the rotating periphery of the wheel is limited through the pivoting attachment of the fixture, resulting in a dynamic adjustment of the knife blade and the fixture in relation to the pressure applied from the balance weight.

SHORT DESCRIPTION OF DRAWINGS

Figure 2:
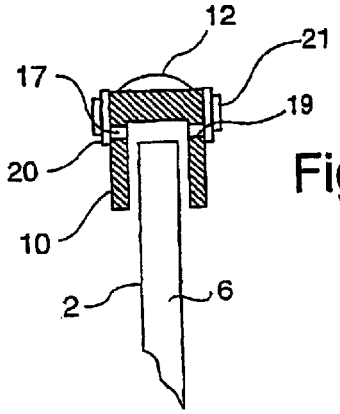
Figure 3:
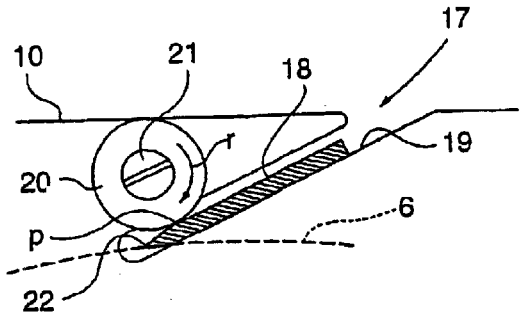

The invention is more closely explained below with reference to the appended diagrammatic drawings, wherein FIG. 1 is an embodiment shown in a partially sectioned view from one side thereof;

FIG. 2 is a diagrammatic sectional view of the invention seen in the direction of arrow II—II in FIG. 1, and FIG. 3 is a view on larger scale showing a knife blade in position for grinding/polishing in a sectioned view from the side.

DETAILED DESCRIPTION OF THE INVENTION

An example of a fixture 1 according to one embodiment of the invention is diagrammatically shown in FIGS. 1–3, the following disclosure being directed towards an implementation for treatment of knife edges. It should however be pointed out that the shown example does not exclude embodiments adapted for cutting edges of different kinds, such as axes, chisels, plane irons, scissors, hedge shears, pruning shears, and other tools having cutting edges suitable for being sharpened.

A grinding or polishing apparatus has a wheel 2 rotatably carried on a shaft 3 inside a protective housing 4, and rotated in direction of arrow R by means of a motor (not shown). A window 5 in the protective cover 4 provides access to a portion of the wheel 2, through which window the knife edge is applied in contact with the periphery 6 of the wheel.

The fixture 1 is attached to the cover 4 or to equivalent structures of the grinding/polishing apparatus by suitable attachment means. To this purpose, the shown embodiment foresees an attachment means 7 having two legs reaching on opposite sides of the cover 4 in the shape of a clamp. The clamp 7 is connected to the cover 4 by means of a bolt 8, reaching through a pair of slots 9 formed in each leg, respectively, of the clamp. Through this attachment, the clamp 7 may be pivoted about the bolt 8 in any desired angular position in relation to the window 5 of the cover, and may also be displaced axially on the bolt 8 for adjusting the circumferential position of the fixture relative to the periphery 6 of the wheel.

A frame structure 10 included in the fixture is carried in the free, upper end of the clamp 7. The frame 10 is pivotally connected with the clamp 7 by means of a shaft 11, forming a pivot to the frame for pivoting motion in a main plane of the grinding/polishing wheel. The pivot axis 11 of the frame is adjustable with respect to the periphery 6 of the wheel, and also with respect to it's circumferential position outside the periphery 6 through the adjustable attachment of the clamp 7 as previously explained.

A balance weight 12 is arranged in the opposite end of the frame 10. The weight 12 is preferably supported for axial adjustment on a bar 13, fixedly accommodated in the end of the frame 10. To this purpose, the weight 12 may be internally formed for threaded engagement with a thread 14 that is formed externally on the bar. The contact pressure applied from the fixture and knife edge towards the periphery 6 of the wheel may thus be controlled, and an accurate operation pressure secured, through the balance weight 12.

The frame 10 preferably has a generally U-shaped section, with two opposing side members connected through a back member such that the frame embraces the wheel 2 like a saddle over the opening 5 of the cover (see also FIG. 2). In a resting position, the fixture 1 rests against the cover 4 or other structural element of the grinding apparatus, for example as is illustrated at 15 and 16, respectively, in FIG. 1 of the drawings.

A slot 17 having an open upper end extends sloping from the back member of the frame 10, down through the side members and for a distance sufficiently long to terminate the slot radially inside the periphery 6 in an operative position of the fixture (see FIG. 3 specifically). The sloping angle of the slot relative to the radius of the wheel, as seen through the contact point of the knife edge with the wheel periphery, may be adjusted and optimized through the adjustable attachment of the clamp 7 as previously discussed. The slot 17 has a width that permits insertion of a knife blade 18, whereby the slot lower surface defines a generally U-shaped support 19 for the lower side of the knife blade. The inner end of the slot 17 comprises a pair of insert limitations 20 arranged on both side members, said limitations being spaced from the support surface 19 by an intermediate distance that is generally adapted to the thickness of the knife blade.

The insert limitations 20 are at least partially arc-shaped and thus providing a pointed contact P with the knife blade a8 inserted in the slot 17. Preferably, the insert limitations 20 are circular discs and rotatably supported (see arrow r in FIG. 3) on the side members of the frame by means of bolts 21. Alternatively, the insert limitations may be oval in shape and pivoted to a position, fixed by the bolts 21, in order to adjust the distance from the support surface 19. Another alternative foresees that the insert limitations are biased towards the support surface 19. Preferably, the insert limitations 20 are produced from a material that is softer than the edge, such as synthetic material like plastic or Nylon®, in order not to damage the knife edge as the knife is inserted in the slot 17.

When grinding/polishing, the knife blade is inserted in the slot 17 with the side of the blade contacting the support surface 19 far enough for the knife edge 22 to bear against the periphery 6 of the wheel, whereupon the knife is longitudinally slided through the slot for treatment of substantially the total length of the knife edge. The insert limitations 20 are adjusted for limitation of the insert depth of the knife blade in the slot, through a point shaped contact with the knife behind the knife edge at an area where the thickness of the blade is decreasing and successively merging with the edge. The concentrated contact point permits the knife blade to be longitudinally moved through the slot, against a limited and reduced frictional resistance.

With the fixture 1, grinding or polishing may be performed under a contact pressure determined by the weight and/or adjusted position of the balance weight, and under an optimized treatment angle. The knife blade is inserted in the slot 17 for a distance determined by the insert limitations 20, whereupon the knife is forced by the rotating periphery of the wheel to be pressed against the insert limitations. The rotational movement of the wheel urges the knife towards the inner end of the slot, while concurrently pressing the knife towards the insert limitations and Lifting the fixture against the weight of the balance 12. The fixture is thus pivoted about the axis 11 of clamp 7 and loading it's weight upon the knife edge. The insert depth of the knife in the slot is therefore not critical for the work result, since the fixture is dynamically adjusted through the pivoted movement in order to exert a substantially uniform pressure to the knife edge as the knife is longitudinally moved through the slot. Thus, the sliding movement may be performed without specific care for a manually controlled pressure, since the operative pressure is controlled by the fixture that dynamically adjusts the load placed on the knife edge via the insert limitations 20.

The fixture disclosed above may be modified in respect of detailed structures and design without departing from the general solution as defined in appended claims. A central aspect of the invention is that the fixture is pivotally supported in the main plane of the grinding wheel for a dynamic adjustment and adaptation to the oppositely directed pressure exerted from the wheel, against the load of an adjustable balance weight that determines the operative pressure. Additional advantages include an optimized and adjustable angle for the treated knife edge, and for the preferred embodiment, also an enclosure that prevents damages from the accessible operative portion of the wheel.

An alternative embodiment foresees a fixture having a guide for a cutting edge to be grinded/polished, the fixture extending on one side only of the grinding wheel. Preferably, the single side fixture is attached to the side turning towards the operator and thereby preventing unintentional contact with the rotating wheel. This embodiment may otherwise be designed in correspondence with the fixture shown in FIG. 1, except for the guiding slot instead having a supporting surface of elongate shape, or with an angled outer end. This less complex fixture may be pivoted about an axis 11 and carried by an arm 7, the arm attached to the grinding apparatus substantially as described above. Furthermore, the insert limitation may be shaped otherwise and realized as an arm, e.g., with an arcuate portion, or as a half-moon shaped element attached to the external side of the fixture. These and other modifications appreciable by the man skilled in the art are all included in the conceptual solution as defined by the appended claim.

What is claimed is:

1. A fixture (1) for guidance of a tool having a cutting edge with respect to the periphery of a rotating grinding- or polishing wheel (2), characterized in that the fixture in it's operational position extends mainly along a portion of the periphery (6) of the wheel and has a guide formed as a slot (17) opening away from the periphery of the wheel, the slot providing a support surface (19) for the tool, said support surface (19) being arranged at a sloping angle relative to a radius of the wheel going through the point of contact between the tool edge and the periphery of the wheel, and the inner end of the slot terminating radially within the periphery (6) of the wheel at least on one side thereof, the fixture (1) in one end supported (11) for pivoting motion in a main plane of the wheel and in the other end carrying a separate balance weight by which the fixture is biased towards the periphery (6) of the grinding- or polishing wheel.

2. The fixture of claim 1, characterized in that the weight (12) is adjustable with respect to a distance from the pivot point (11) for adjusting the load of the fixture and thus the contact pressure from the edge bearing on the periphery of the wheel, in operational position.

3. The fixture of claim 1, characterized in that the slope angle of the slot (17) relative to the radius of the wheel going through the point of contact between the tool edge and the periphery of the wheel is controllable through adjustment of the pivot point (11) with respect to a radial distance from the centre of the wheel (2).

4. The fixture of claim 1, characterized in that the slope angle of the slot (17) relative to the radius of the wheel going through the point of contact between the tool edge and the periphery of the wheel is controllable through adjustment of the pivot point (11) with respect to it's circumferential position outside the periphery (6) of the wheel.

5. The fixture of claim 1, characterized by an insert limitation (20) opposite the support surface (19), the limitation having an arcuate surface for pointed contact (P) with a tool that is inserted in the slot (17) to rest against the support surface (19).

6. The fixture of claim 5, characterized in that the limitation (20) comprises a pair of discs, one disc being arranged on each side of the fixture, respectively.

7. The fixture of claim 6, characterized in that the limitation (20) is rotatably supported and manufactured from a material that is softer than the edge to be treated, such as a synthetic material and preferably plastic or Nylons®.

8. The fixture of claim 6, characterized in that the disc is biased towards the support surface.

9. The fixture of claim 6, characterized in that the disc is oval in shape and may be fixedly secured in the subject angular position.

10. The fixture according to claim 1, characterized in that two side members connect to a back member that embraces opposite sides of an accessible portion of the wheel periphery substantially like a saddle, and the support surface (19) is U-shaped in a planar view.

11. The fixture according to claim 2, characterized in that two side members connect to a back member that embraces opposite sides of an accessible portion of the wheel periphery substantially like a saddle, and the support surface (19) is U-shaped in a planar view.

12. The fixture according to claim 2, characterized in that two side members connect to a back member that embraces opposite sides of an accessible portion of the wheel periphery substantially like a saddle, and the support surface (19) is U-shaped in a planar view.

13. The fixture according to claim 3, characterized in that two side members connect to a back member that embraces opposite sides of an accessible portion of the wheel periphery substantially like a saddle, and the support surface (19) is U-shaped in a planar view.

14. The fixture according to claim 5, characterized in that two side members connect to a back member that embraces opposite sides of an accessible portion of the wheel periphery substantially like a saddle, and the support surface (19) is U-shaped in a planar view.

15. The fixture according to claim 6, characterized in that two side members connect to a back member that embraces opposite sides of an accessible portion of the wheel periphery substantially like a saddle, and the support surface (19) is U-shaped in a planar view.

* * * * *